United States Patent [19]

Weinar

[11] 4,333,286

[45] * Jun. 8, 1982

[54] WALLS AND PARTITIONS AND CONCEALED FASTENERS FOR ASSEMBLY THEREOF

[76] Inventor: Roger N. Weinar, 19 Parkside Ave., Hamburg, N.Y. 14075

[ * ] Notice: The portion of the term of this patent subsequent to Oct. 3, 1995, has been disclaimed.

[21] Appl. No.: 184,961

[22] Filed: Sep. 8, 1980

Related U.S. Application Data

[63] Continuation-in-part of Ser. No. 947,078, Sep. 29, 1978, Pat. No. 4,221,095, and Ser. No. 171,331, Jul. 23, 1980, Pat. No. 4,296,580, which is a continuation-in-part of Ser. No. 736,425, Oct. 28, 1976, Pat. No. 4,117,644.

[51] Int. Cl.[3] ..... E04B 1/00

[52] U.S. Cl. ..... 52/281; 52/471; 52/489; 52/509; 52/714

[58] Field of Search ..... 52/481, 489, 281, 714, 52/483, DIG. 6, 509, 715, 471, 468

[56] References Cited

U.S. PATENT DOCUMENTS

| | | | |
|---|---|---|---|
| 2,101,001 | 11/1937 | Balduf | 52/489 |
| 2,281,519 | 4/1942 | Faber | 52/489 X |
| 2,706,315 | 4/1955 | Prize | 52/489 X |
| 2,779,978 | 2/1957 | Sundeln et al. | 52/489 X |
| 2,831,222 | 4/1958 | Anderson | 52/489 |
| 3,047,985 | 8/1962 | Murphy | 52/483 |
| 3,308,590 | 3/1967 | Ettore et al. | 52/281 |
| 4,000,596 | 1/1977 | Magill et al. | 52/481 |
| 4,052,831 | 10/1977 | Roberts et al. | 52/363 X |
| 4,127,975 | 12/1978 | Judkins | 52/489 |
| 4,221,095 | 9/1980 | Weinar | 52/489 |

FOREIGN PATENT DOCUMENTS

| | | | |
|---|---|---|---|
| 1362162 | 4/1964 | France | 52/714 |

*Primary Examiner*—Price C. Faw, Jr.
*Assistant Examiner*—Carl D. Friedman
*Attorney, Agent, or Firm*—Raymond F. Kramer

[57] ABSTRACT

Walls and partitions are constructed by securing of wallboard panels to a substructure, such as common wood or metal framing members, by a series of concealed clips of described construction, affixed to the framing members by nail or screw type fasteners. When the wall or partition is erected the fasteners are hidden from view so that joint treatment of the wallboard panels may be reduced or eliminated, depending on the type of wall structure constructed. The side or edge gripping clips are impaled along each side of abutting panels. When erected, a first series of clip fasteners are impaled on a side of a first wallboard and fastened to a framing member and a second series of such fasteners are impaled on an abutting or nearly abutting side of a second, wallboard panel, offset from the first series of clips so as to fit behind and be held by the first panel in a "tongue and groove" type cooperation. The invented fasteners include strengthening wall portions that reinforce them and create a clearance or spacing between the substructure framing member and the backs of the panels, while also providing for screw or nail head clearance. Also disclosed are such clips and wall and partition structures with features that permit easier disassembly of the structures, or spacing apart of the wallboard ends to allow for filler or filler strip insertion, when such may be desirable.

39 Claims, 17 Drawing Figures

WALLS AND PARTITIONS AND CONCEALED FASTENERS FOR ASSEMBLY THEREOF

This application is a continuation-in-part of my copending applications, Ser. No. 947,078, filed Sept. 29, 1978 now U.S. Pat. No. 4,221,095 and Ser. No. 171,331 filed Sept. 23, 1980 now U.S. Pat. No. 4,296,580. U.S. Pat. No. 4,221,095 is a continuation-in-part of application Ser. No. 736,425 filed Oct. 28, 1976 now U.S. Pat. No. 4,117,644 and U.S. Pat. No. 4,296,580 is a continuation-in-part of Ser. No. 947,078. The disclosure of such patents are incorporated herein, by reference.

The present invention relates to wall and partition construction and more particularly to the use of easily installed clip fasteners to mount panels, such as paper wrapped gypsum wallboards, on common wall framing members such as wood or metal studs and furring runners. The wallboards employed may be produced by various methods and may be of any suitable compositions but they are usually comparatively thin rectangular panels with gypsum cores and a paper covering. These commonly named "drywall" panels are available with a decorative, factory appled surface cover, such as textured vinyl, which eliminates the need to paint and otherwise treat the wall after erection. Permanent walls, or those not expected to be moved or relocated are often constructed of unfinished wallboards which are tapered at ends thereof to a thickness less than the main portion of the wallboard, to allow for application of a plaster compound used in a joint treatment. Such treatment normally includes three separate applications of a wet cement-like joint compound, with the material applied first having a paper or fiber tape imbedded therein. The joint compound must be allowed to dry thoroughly (shrink) after each application and it is not uncommon to have to wait a full day or longer between such applications. A similar application of joint compound is used to fill depressions made by the exposed fasteners on each wallboard panel between the joints. The use of pre-finished wallboard panels, of course, eliminates the need for this wet joint treatment, but they cannot be fastened to the framing members by ordinary techniques because the fasteners would be exposed and impair the desired appearance of the finished surface. Accordingly, concealed fasteners or clips are highly desirable for the erection of walls from pre-finished wallboards. Such clips can also have applications in constructing walls from unfinished wallboard panels, which often may also have appropriate joint changes to improve assembly.

Various concealed clip devices for holding prefinished wallboards to framing members and other substructures have been described, and several of these have been marketed. Among the more successful of such fasteners are those described in my U.S. Pat. No. 4,117,644, which are now widely used in the construction industry. However, while such fasteners are economical, labor reducing and satisfactorily hold the assembled wallboard panels in position, assembly and disassembly of the wallboard panels has to be effected sequentially. In one form of the present invention the modified clips shown may be disengaged from the fasteners to permit any pair of wallboard panels to be dismounted from the framing structure when the desired panel is slightly shifted vertically on the framing members. In another form of the clip, particularly useful in the construction of permanent wall structures, a panel separating spacer is provided on each clip to permit a unique system of joint treatment. The invented clips may be used for the assembly of walls when new methods of joint treatment are employed, all of which require concealed clips and standard or modified wallboards and methods.

The closest prior art known to me is my patent described above. In addition thereto, it is considered that the following references may also be considered to be relevant: U.S. Pat. Nos. 1,052,670; 2,281,519; 2,325,766; 3,047,985; 3,117,353; 3,187,389; 3,308,590; 4,010,589; 4,052,831; 4,127,975; 4,128,979; 4,221,095; and French Pat. No. 1,362,162. Additionally, my Pat. No. 4,281,494, issued Aug. 4, 1981, may also be relevant. However, none of the applicable art describes the broad invention of this application nor the various more specific embodiments thereof described herein.

In accordance with a broader aspect of the present construction a wall or partition comprises a substructure and a surface structure, said substructure including framing or supporting means for holding the surface structure, and surface structure comprising first and second side abutting or approaching substantially flat panels, each of which has concealed major back, side, top and bottom surfaces and a visible major front surface, which panels are substantially invisibly secured to the substructure and together by a first series of spaced apart concealed fastener clips appended to said first panel and to the substructure and a second series of spaced apart fastener clips appended to said second panel and so located as to avoid contact with any of said first series of clips, with each of the clips of both said series being made from sheet or strip material and having base portions extending substantially parallel to said respective panels at concealed major back surfaces thereof, with said base portions each having a spaced apart substructure contacting surface on one side of the material thereof and a panel contacting surface on the other side, contacting the major back surface of the panel to which the clip is appended, which clip surfaces are spaced apart by intermediate strengthening wall(s), and with a part of each of the panel contacting surfaces of the second series of clips contacting the major back surface of the first panel, a plurality of web portions extending from said base portions and between the first and second panel sides, and pointed tabs extending from said web portions, impaling a side of the respective panel to which the clip is appended. Also within the invention are the concealable fasteners mentioned, and various improvements thereof.

In accordance with the present invention a wall or partition comprises a substructure and a surface structure, said substructure including framing or supporting means for holding the surface structure to and spaced away from the substructure, and said surface structure comprising first and second aligned substantially flat panels, adjacent at sides thereof, each of which has concealed major back, sides, top and bottom surfaces and a visible major front surface, the sides of which panels are substantially straight and flat, which panels are substantially invisibly secured to the substructure and spaced away from it, and thereby are secured together or spaced apart a spacing distance, by a first series of spaced apart concealed fastener clips appended to said first panel and to the substructure, and a second series of spaced apart concealed fastener clips appended to said second panel, so located as to avoid contact with any of said first series of clips and with a part of each of the panel contacting surfaces of each of the second series of clips contacting the major back surface of the first panel and spacing such surface from the framing or supporting means, with each of the clips of both said series being made from sheet or strip material and having spacing base portions, each of which is substantially coplanar and directly continuous, extending substantially parallel to said respective panels at concealed major back surfaces of said panels, with said spacing base portions each having, spaced apart, a substructure contacting surface on one side of the material thereof and a panel contacting surface on the other side, which spacing base portions space the major back panel surface from the framing or supporting means a distance greater than the thickness of the material of the clips, and which clip surfaces are spaced apart by intermediate strengthening wall(s), a plurality of web portions extending from each of said base portions and between the adjacent first and second panel sides, and pointed tabs extending from said web portions, impaling a side of the panel to which the clip is appended.

With respect to the invented fastener, which is useful for installing wallboard or similar panels onto a substructure to form a wall or partition, wherein means for holding such panels to the substructure are substantially concealed, such fasteners are made from sheet or strip material and comprise a substantially coplanar and directly continuous spacing base portion which includes, spaced apart, a substructure contacting surface on one side of the material thereof and a panel contacting surface on the other side, spaced apart by intermediate strengthening wall(s), which spacing base portion spaces a major back panel surface of the panel from said substructure a distance greater than the thickness of the sheet or strip material of the clip, when such clip is installed, a plurality of web portions extending at about a right angle from said base portion, and pointed tabs, extending from said web portions and suitable for impaling a substantially flat side of a panel to which the clip is appended, with the panel contacting surface of the base contacting a major back surface of the panel and with the webs contacting a substantially flat side thereof.

The invention will be readily understood by reference to the description herein, taken in conjunction with the drawing, in which.

Figure 1:
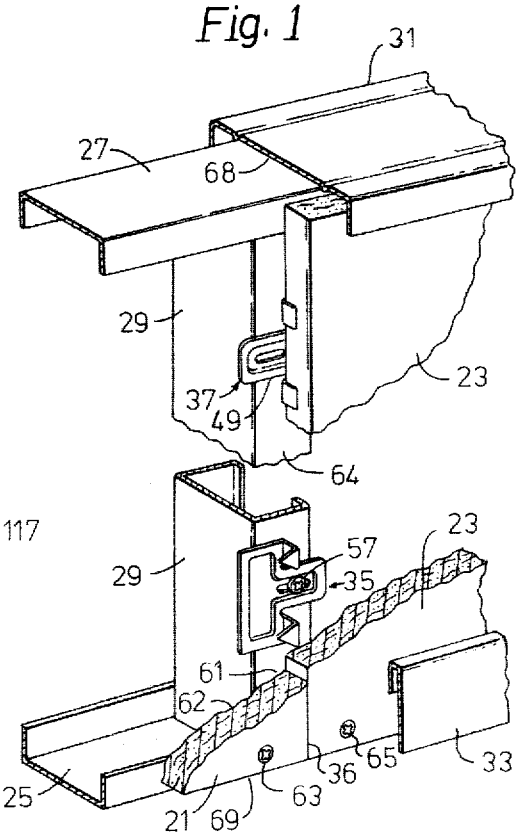
FIG. 1 is a fragmentary perspective view of a demountable vertical wall structure or assembly with wallboard panels removed or cut away to show normally concealed clips of this invention.

Referring to FIG. 1, prefinished wallboard panels 21 and 23 are cut away in part to expose the metal framing members of a common type of partition construction, in which floor track 25 and ceiling track 27 are channel shaped runners that capture typical stud runner 29. Ceiling trim channel 31 and floor base moulding 33 conceal the unfinished ends of the wallboard panels. Opposing clips 35 and 37 work in conjunction with each other and with a plurality of other such alternating clips to hold the wallboard panels against the stud at the joint or line of joinder 36 of the panels. Exposed clips 35 and 37 represent series of clips affixed to each of the described wallboard panels. The clips are positioned in alternating arrangement and normally as when four feet by eight feet (1.2 by 2.4 meters) wallboard are installed, 4 to 20 clips will be utilized, preferably 6 to 10, with 2 to 10 clips on each abutting wallboard edge, preferably 3 to 5.

Figure 2:
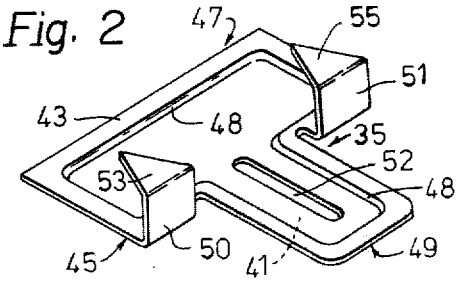
FIG. 2 is a perspective view of a clip of this invention of the type illustrated in FIG. 1, showing the peripheral rigidizing and spacing wall thereof.

Exposed clips 35 and 37 are of the structure of clip 35, shown in FIG. 2, which has a flat framing member contacting surface 41 and a flat panel contacting surface 43, in a part thereof which is identified as base 45. Such base includes plate and tongue parts 47 and 49, respectively, and slot 52 is primarily in the latter section, as shown. Intermediate wall portion 48 spaces apart the framing and panel abutting surfaces, strengthening the clip fastener against bending and twisting, and maintaining a desired clearance between the panels and the framing members, e.g., 1 to 5 mm, preferably 2 to 4 mm., while providing a clearance for a fastener (screw, rivet or nail) head. A pair of web portions 50 and 51 project from the base 45 and a pair of pointed tabs 53 and 55, which pierce the concealed edges of each wallboard panel, extend respectively from the webs. The webs and tongue are spaced apart, as shown at 56, preferably by a distance (between a web and the tongue) of 1 to 4 mm., more preferably 1.5 to 3 mm., which facilitates manufacture and installation. The clip illustrated in FIG. 2 (as well as other fasteners shown herein) is made of a single sheet of material, preferably hardened spring steel strip or sheet, such as SAE 1050 high carbon spring steel (1030–1060 may also be employed), which is annealed before forming and after forming is heat treated (hardened) to a Rockwell hardness in the range of C-24 to C-34, preferably C-28 to C-30. However, it is within this invention to utilize other suitable materials, such as sheet steel and other metals, including aluminum and magnesium-aluminum alloys, synthetic organic polymeric plastics, such as nylons, polyacrylates, fiberglass reinforced polyesters and engineering plastics. Such materials may be folded or otherwise shaped to form. Preferably, when metal is being utilized, an essentially flat piece of material, cut to desired pattern, will be stamped and bent so that the surfaces resulting, e.g., panel contacting surface part, framing contacting surface part and pointed tab parts, are parallel or essentially parallel to each other and the web and spacing and strengthening wall portions are essentially at right angles to said parts. However, the intermediate wall parts may be at angles other than a right angle to the plate, sometimes being as little as 30°, but preferably will be from 45° or 60° to 90°. Similarly, the points may be at 60° to 90°, preferably being from 75° to 90°. At less than 90° they may even tend to grip the panel better, due to resilience thereof after initial installation distortion.

Referring again to FIG. 1, it can be seen that clip 35 (representing a series of clips similarly installed), is appended to wallboard panel 21 by impalement and is mechanically secured to the stud member 29 by fastener 57. It is a common practice to use self-drilling, self-tapping screws and an electric screw driver for this purpose. Abutting wallboard panel 23 also has a series of clips, represented by clip 37, appended to it and offset from clips 35, so that the tongue area part 49 of clip 37 slides into clearance opening or space 61 between the back major surface 62 of the wallboard panel and the front face 64 of the stud framing member. Such spacing is maintained by and equals the thickness of the clips. Clips 37, impaled in panel 23, are also held in place by secured wallboard panel 21. The clips along the other edge of panel 23 (not shown) are fastened to that panel in the same manner as clips 35 are held to panel 21. The installation continues as each abutting panel is progressively mounted in this "tongue and groove" manner. In FIG. 1 it may be seen that the bottom end of each wallboard panel is also screw fastened with longer self-drilling, self-tapping screws 63 and 65. The removable floor base moulding 33 covers and provides access to these screws. The top of the wallboard panels is held against the ceiling track 27 by resilient trim channel 31 and no fasteners are required at the top. Wallboard panels 21 and 23 are positioned so that a space 67 remains between the top of each panel and the web 68 of the ceiling track. A space 69 is also provided at the bottom of each panel by elevating the wallboards off the finished floor, not shown. Such spaces are useful to permit the wallboard panels to be raised or lowered to disengage accessible clips, which will be disclosed subsequently herein.

Figure 3:
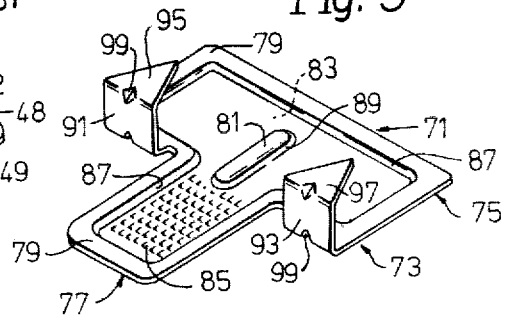
FIG. 3 is a perspective view of a clip similar to that illustrated in FIGS. 1 and 2, provided with additional rigidizing indentations at the webs thereof and a knurled (or plurally indented or upraised) fastener surface in the tongue part of the clip.

In FIG. 3 there is shown a modified form of the clip fastener of FIG. 2, clip 71, which includes a substantially flat base portion 73, having plate and tongue parts 75 and 77, respectively, and panel abutting surfaces 79 and 81 and framing or substructure abutting surface 83. Also shown in FIG. 3 are stabilizing intermediate wall portions 87 and 89, webs 91 and 93 and pointed tabs 95 and 97. Stiffening indentations or ribs 99, provided in the web corners, help the thin metal part resist deformation both in heat treatment, if required, and during installation, and also may help to inhibit lateral movements of the installed clips. A knurled tongue area 85 prevents screw fastener "run-off" by providing a multiplicity of possible centering wells for the fastener point. Such knurling, indenting, grooving, surface roughening or other equivalent treatment also eliminates any need for a fastener slot or hole in the tongue or base, if the proper metal piercing tools are available, which makes this clip particularly useful in applications that might sometimes require or allow the clip to be fastened by welding or by a suitable adhesive.

Figure 4:
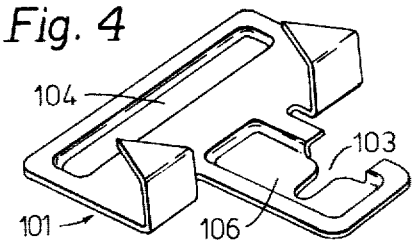
FIG. 4 is a perspective view of another clip, similar to that illustrated in FIGS. 1 and 2, and provided with an open key hole slot in a side of the tongue part of the clip.
Figure 14:
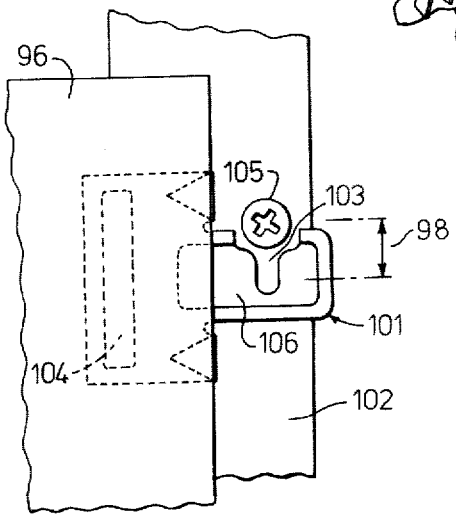
FIG. 14 is a front elevational view of an installed clip of the type shown in FIG. 4, illustrating the positioning possible to permit such clips and the wallboard panel to be engaged by or disengaged from the screw fastener.

FIG. 4 illustrates a clip 101, similar to clip 35 of FIG. 2, but with separate depressed base sections 104 and depressed tongue section 106, each with surfaces to contact the framing member, and an open keyhole type of slot 103 in the tongue top side so that the clip can be disengaged from its fastener, as better illustrated in FIG. 14, where clip 101 and wallboard panel 96 have been lowered a short distance 98 so that the clip, as shown, is free of the head of fastener 105. After wallboard panel 96 and its abutting panel (not shown) are lowered to the position illustrated, both panels may be urged from the surfaces of framing member 102 and these panels may then be swung outward and may be removed, to provide access to the wall cavity. To replace the panels the procedure is reversed and the wallboard panels are again elevated to their original locked position, where they may be independently supported, as by screws, like those shown at 63 and 65 of FIG. 1. A reverse installation of the clip may sometimes be desirably effected, with the clip side opening facing downwardly so that the wallboard is raised for dismantling.

Figure 15:
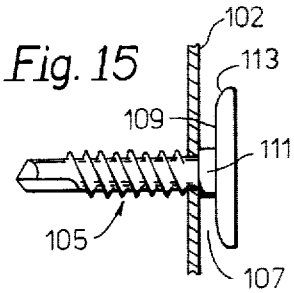
FIG. 15 is an enlarged partially cutaway horizontal sectional view of a part of a clip, as shown in FIG. 14, and a self-drilling, self-tapping, sheet metal screw, as shown in FIG. 14, illustrating the shoulder spacing element and the lead-in, wedge-locking head configuration of the screw.

The holding of the wallboard panel to the substructure can be assisted by the use of a special spacing screw 105, illustrated in FIG. 15, in which a predetermined space 107 is maintained between the screw head 109 and the surface of the metal framing member 102 by the introduction of a shaft shoulder 111. Such a screw may also be provided with a lead-in edge 113 to help direct the return of the FIG. 4 clip to a locked position. A lubricated coating or washer, not shown, could be useful in some applications.

Figure 5:
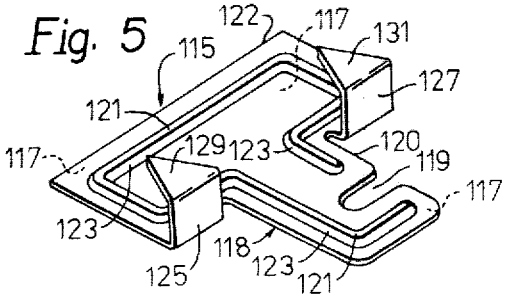
FIG. 5 is a perspective view of another clip similar to that illustrated in FIGS. 1 and 4, with a modified rigidizing wall and a suitable slot in the tongue part of the clip.

In FIG. 5 is illustrated another modified clip 115, having a relatively large, flat framing member abutting surface 117 of base portion 118, with an open slot 119 in the tongue part or area 120, a relatively thin, sinuous upper panel abutting surface 121, in both tongue 120 and plate 122 parts, strengthening and spacing wall parts 123 intermediate the framing and panel contacting surfaces, a pair of web portions 125 and 127 and a pair of pointed tabs 129 and 131. The proportions of the panel abutting surface and the framing member abutting surface may be adjusted in the clip design, as will be described later, to compensate for different hardnesses of building materials. For instance, when a relatively soft fiberglass wallboard panel is being secured to a metal framing structure the area of the clip contacting the panel is desirably greater but the reverse could be true when a relatively hard wallboard panel, such as one based on a dense gypsum, is being secured to a soft substrate, such as a foam stud structure.

Figure 6:
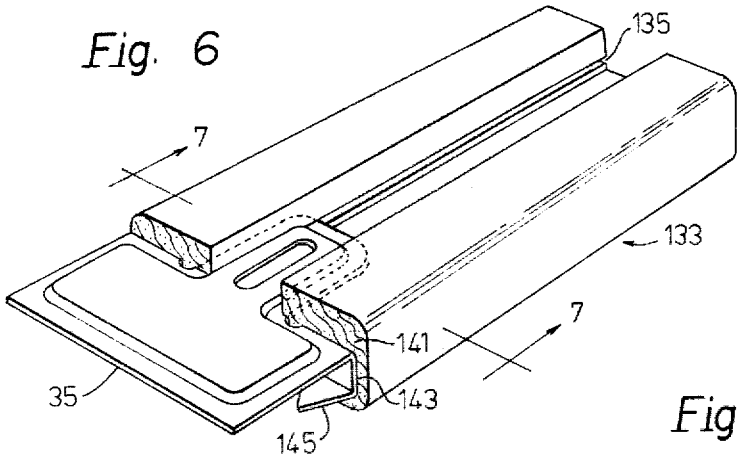
FIG. 6 is a perspective view of a driving tool in action, installing a clip of the type illustrated in FIGS. 1 and 2.
Figure 7:
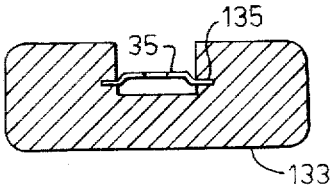
FIG. 7 is a sectional view of the tool and clip, taken along lines 7—7 of FIG. 6.
Figure 8:
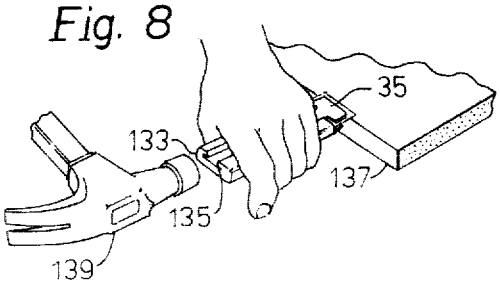
FIG. 8 is a pictorial view illustrating the operation of the driving tool of FIGS. 6 and 7.

In FIG. 6 there is shown an elongated channel shaped tool 133, which holds typical clip 35 in a pair of matching coplanar slots, such as that identified by numeral 135, in the side walls 134 channel 136 therein. The tool is used to aid the appending of the clip to a wallboard panel 137, as is depicted in FIG. 8. A striking tool, such as hammer 139, may be used to drive the clip. However, many mechanics use only hand pressure on the tool to impale the wallboard panel with the clip fastener and find it sufficient to drive pointed tabs 145 their full lengths into a panel. It will be noted that the driving force from the tool is transmitted to the clip by tool ends 141 against clip webs 143, and that contact is along the entire exposed web surfaces. Whether the clip is held in the tool slots as shown or in reverse relationship, the ends 141 are of great enough areas to cover the webs 143. The material of construction of the tool is preferably wood but synthetic organic polymeric plastics and metal may also be used.

Figure 9:
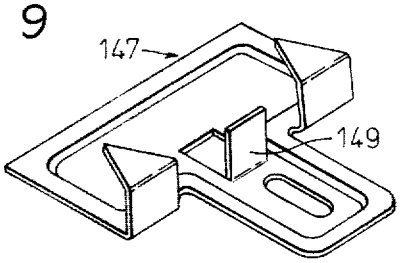
FIG. 9 is a perspective view of a clip similar to that shown in FIG. 2, with a wallboard spacing element, shown in the tongue part of the clip.
Figure 10:
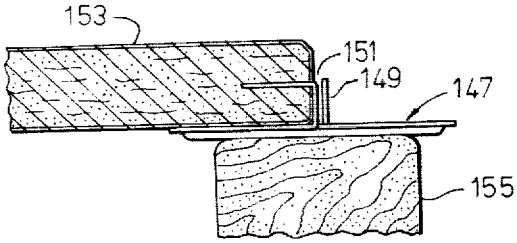
FIG. 10 is a horizontal sectional view of a vertical wall assembly fragment, illustrating an installed clip of the type illustrated in FIG. 9.
Figure 11:
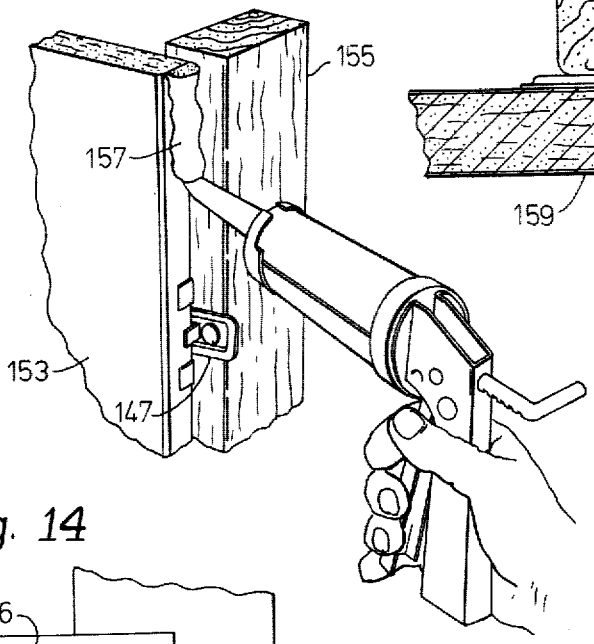
FIG. 11 is a perspective view of the wall assembly fragment of FIG. 10, illustrating a modified joint treatment possible with the clip illustrated in FIGS. 9 and 10.
Figure 12:
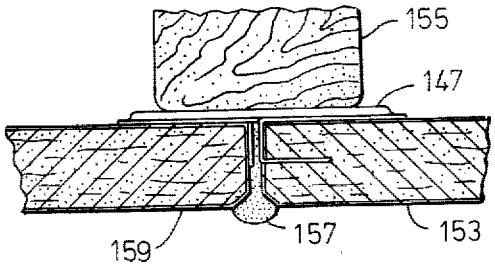
FIG. 12 is a horizontal sectional view of a wall fragment constructed according to FIGS. 10 and 11, with a second wallboard in location, illustrating a partially completed joint, with joint filling medium in place therein.
Figure 13:
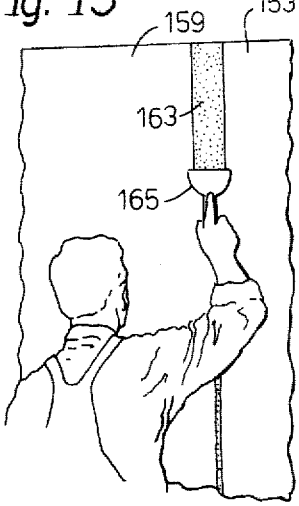
FIG. 13 is a pictorial view illustrating the final surface treatment completing the joint illustrated in FIG. 12.
Figure 16:
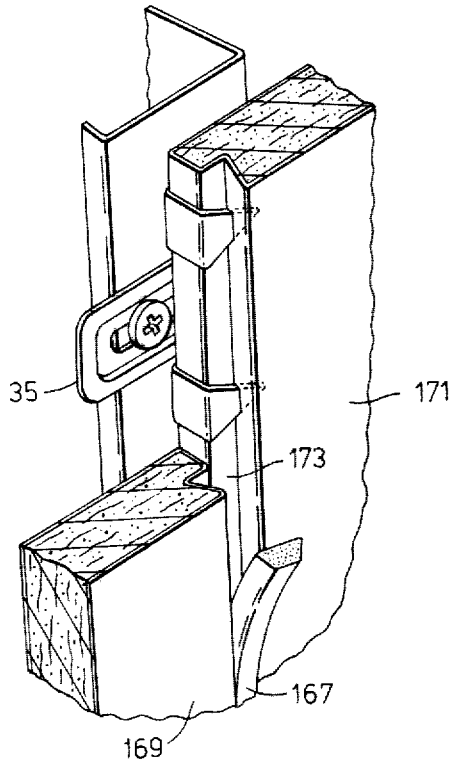
FIG. 16 is a perspective view of a part of a wall assembly comprising clip fasteners of the type shown in FIG. 2 and a wallboard panel of a configuration which permits the modified joint treatment illustrated.

Referring now to FIG. 9, modified clip 147 includes punched out third offset web portion 149, for maintenance of a predetermined space 151 between two nearly abutting wallboard panels, as is better shown in FIG. 10. After a wallboard panel 153 has been secured to framing member 155 by clip 147 a suitable joint compound, plaster, grout, mortar, caulk or other filling material 157 may be applied to the side of the wallboard (and the framing member), as is shown in FIG. 11. In FIG. 12 the nearly abutting adjacent panel 159 is shown after installation, held by its clip, not shown, which is a duplicate of clip 147 (both clips, of course, represent series of clips). The excess of compound 157 protrudes from the joint and is leveled to a smooth joint surface 163 with a suitable smoothing tool 165, such as a trowel or putty knife, as is depicted in FIG. 13. This type of construction and joint treatment is very useful where fireproof joints are required. The partition can be built with standard beveled, tapered or thinned edge wallboard panels. However, the effective width of each panel, which is normally 48 inches wide (1.2 meters) is increased by the spacing clip and should be compensated for in the overall structure. In FIG. 16 this problem has been eliminated by incorporating a spacing strip in modified wallboard panels 169 and 171, permitting the use of standard clip 35. The groove 173 formed by the abutting panels may then be treated with any suitable means, such as pre-applied or post-applied wet compound or an elongated strip of elastomeric and/or plastic material 167, can be inserted in the groove, as is shown. The strip can subsequently be smoothed with a wet, dry or hot melt treatment or could provide a decorative finish in itself.

Figure 17:
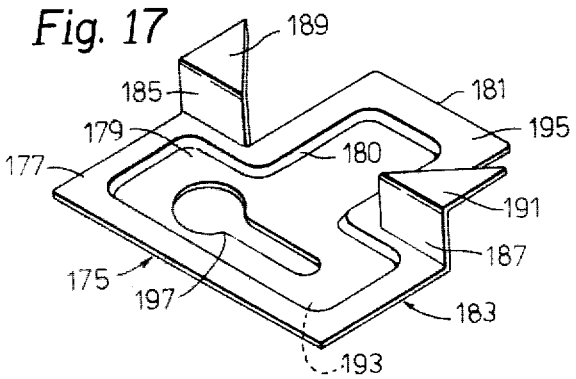
FIG. 17 is a perspective view of a modified clip having a closed keyhole slot in an enlarged tongue portion, with webs and points extending from the base.

FIG. 17 shows a clip of a different basic design, which may be considered as a modification of the clip illustrated in French Pat. No. 1,362,162, with the additional advantages of the reinforcing spacing construction of the clips of this invention. In such figure, clip 175 has an enlarged tongue portion 177 with a reinforcing walled depression 179, including wall 180, in such tongue portion and extending into plate portion 181, both tongue and plate being part of what may be characterized as base 183. As shown, webs 185 and 187 and the corresponding pointed tabs 189 and 191, are made from metal "taken out of" plate portion 181. The illustrated clip has substructure contacting surface 193 and panel contacting surface 195. An enclosed keyhole shaped slot 197 in tongue portion 183 (actually in the depressed portion thereof) facilitates ready disassembly of the wallboard panels when such is desirable, in the manner discussed with respect to FIGS. 4, 5 and 14. It will be evident that making the tongue portion larger, which may be effected by deriving the webs and points, in effect, from the plate portion of the blank, supplies the additional material desirable for providing a keyhole or other suitably shaped opening in the tongue (the tongue being that part of the fastener clip projecting from the wallboard after installation). Similar modified structures may be made based on others of the previously illustrated clips by reversing the direction in which the tabs point, thereby, in effect, interchanging the plate and tongue portions thereof.

The advantages of the described invention are significant with respect to various other concealable wallboard fastening clips known in the art. Easy insertion of the next wallboard during wall or partition assembly is extremely important and the provision of spaced apart panel contacting and substructure contacting surfaces on the clip to space apart the wallboard and the panel, while at the same time strengthening the clips, is a feature of this invention which makes the described clips and assembled walls greatly superior to those of the prior art and those previously commercially employed. The ratios of panel contacting and substructure contacting surface areas of the clips should be in the range of 1:14 to 14:1 and preferably will be in the range of 1:7 to 7:1, often being from 1:3 to 3:1, and in present commercial embodiments of the present clips being in such range. However, by choice of the location of the respective surfaces the ratios may be varied within the ranges given so that the clips will be held in a balanced, non-rocking relationship between framing and wallboard. Also, as was indicated previously, the proportion of clip surface area contacting a relatively harder material may be diminished whereas that in contact with the softer material will preferably be increased. The intermediate strengthening walls are considered to be of a length or depth corresponding to the distance between a part of the material with a surface in contact with the substructure and a part of the material with a surface in contact with the panel. Such depth should be at least ¾ the thickness of the sheet or strip material of which the clip is made and preferably will be from ¾ to 5 times such thickness, e.g., 1 to 3 times such thickness. The length of such wall or plurality of walls, in total, will be at least 10% of the periphery of the base portion, preferably at least 25% thereof and more preferably at least 50% thereof but often such length will be about 100% or up to 200%. If such proportions, lengths and depths are not employed the clips made will not be as useful and the walls built with them will not be as secure and true.

The invention has been described as applicable to the installation of vinyl covered or ordinary wallboard onto metal or wooden framing but it may also be employed to apply other sheet materials, such as wood paneling, on the same and different types of framing. The advantages obtainable in such different uses are comparable to those already described.

The invention has been described with respect to various embodiments and illustrations thereof but is not to be considered as limited to them because it is evident that one of skill in the art with the present specification before him will be able to utilize substitutes and equivalents without departing from the spirit of the invention.

What is claimed is:

1. A wall or partition comprising a substructure and a surface structure, said substructure including framing or supporting means for holding the surface structure, and said surface structure comprising first and second aligned substantially flat panels, adjacent at sides thereof, each of which has concealed major back, sides, top and bottom surfaces and a visible major front surface, which panels are substantially invisibly secured to the substructure and thereby are secured together or spaced apart a spacing distance by a first series of spaced apart concealed fastener clips appended to said first panel and to the substructure, and a second series of spaced apart concealed fastener clips appended to said second panel, so located as to avoid contact with any of said first series clips, and with a part of each of the panel contacting surfaces of each of the second series of clips contacting the major back surface of the first panel and spacing such surface from the framing or supporting means, with each of the clips of both said series being made from sheet or strip material and having spacing base portions, each of which is substantially coplanar and directly continuous, extending substantially parallel to said respective panels at concealed major back surfaces of said panels, with said spacing base portions each having, spaced apart, a substructure contacting surface on one side of the material thereof and a panel contacting surface on the other side, which spacing base portions space the major back panel surface from the framing or supporting means, which clip surfaces are spaced apart by intermediate strengthening wall(s), a plurality of web portions extending from each of said base portions and between the ajdacent first and second panel sides, and pointed tabs extending from said web portions, impaling a side of the panel to which the clip is appended, and wherein the clip fasteners of the second series of clips include reinforcing and lateral movement inhibiting indentations in web portions thereof.

2. A wall or partition comprising a substructure and a surface structure, said substructure including framing or supporting means for holding the surface structure, and said surface structure comprising first and second aligned substantially flat abutting panels, in contact at sides thereof, each of which has concealed major back, sides, top and bottom surfaces and a visible major front surface, which panels are substantially invisibly secured to the substructure and thereby are secured together or spaced apart a spacing distance by a first series of spaced apart concealed fastener clips appended to said first panel and to the substructure, and a second series of spaced apart concealed fastener clips appended to said second panel, so located as to avoid contact with any of said first series of clips, with a part of each of the panel contacting surfaces of each of the second series of clips contacting the major back surface of the first panel and spacing such surface from the framing or supporting means, and with panel contacting surfaces of the clips of the first series contacting the major back surface of the second panel, said clips of both series being concealed by the contacting sides of the adjacent panels, with each of the clips of both said series being made from sheet hard steel and having spacing base portions, each of which is substantially parallel to said respective panels at concealed major back surfaces of said panels, with the ratio of surface area proportions of the clip substructure contacting surface and panel contacting surface being from 1:7 to 7:1, with said spacing base portions each having, spaced apart, a substructure contacting surface on one side of the material thereof and a panel contacting surface on the other side, which spacing base portions comprise substantially coplanar directly connected plate and tongue parts and space the major back panel surface from the framing or supporting means, and which clip surfaces are spaced apart by intermediate strengthening wall(s) about 1 to 3 times the thickness of the hard steel sheet material of which the clips are made, at least as long as 25% of the periphery of the base portion, and at about a right angle to the substructure contacting and panel contacting surfaces of the clips, which surfaces are substantially parallel to each other, a plurality of web portions extending from each of said base portions only from the plate part thereof and between the adjacent first and second panel sides, and pointed tabs extending from said web portions in the direction of the plate part, impaling a side of the panel to which the clip is appended.

3. A wall or partition according to claim 2 wherein the clips of the second series comprise peripherally located panel contacting surfaces and interiorly located framing contacting surfaces, the webs of the clips, of which there are two for each clip, are spaced apart from the tongue thereof, which is centrally located, and the tongue includes a longitudinal slot for adjustable fastening of the clips to a framing member.

4. A wall or partition according to claim 2 wherein the clips of the second series include a depressed interior part of the tongue part, which depressed part includes a plurality of indentations on a surface thereof facing a panel back surface so as to provide a plurality of possible starting locations for penetrating said part of the tongue for passage therethrough of a fastener for fastening the clip to a framing member when such fastening is desired.

5. A wall or partition according to claim 2 wherein the second series clips comprise an interiorly located panel contacting surface and an exteriorly located, with respect to such interior panel contacting surface, framing contacting surface, with the panel contacting surface having a substantial proportion thereof in the plate part of the base portion of the clip, and being surrounded by a substantially panel contacting surface of the base portion, whereby improved stability is obtained in the holding of the clips to the wallboard and in the holding of the wallboard to the framing member.

6. A wall or partition according to claim 2 wherein the second series clip fasteners comprise reinforcing and lateral movement inhibiting indentations in the web portions where they are joined to the plate and pointed tab portions, respectively, which indentations extend to such plate and tab portions.

7. A wall or partition according to claim 2 wherein all of the first series clip fasteners include a slot opening in the tongue portion thereof, transverse to the direction in which said tongue extends and passing from a side of said tongue to an interior part thereof, so as to provide a path for movement of the wall or partition in a direction at right angles to that in which it is assembled, with respect to means for holding it to the framing member, to facilitate disassembly of the wall or partition when such may be desired.

8. A wall or partition according to claim 7 wherein a panel or substructure contacting surface of the clip fastener is in the form of a strip substantially paralleling the periphery of the clip, interrupted near the slot opening in the tongue portion thereof, interiorly located with respect to said periphery and supported by a rigidifying and spacing wall.

9. A wall or partition according to claim 2 wherein the clips include third webs, located between the other two webs and extending in the same direction but with the plane thereof at a spacing distance from the plane of the other webs so as to space the installed wallboards apart approximately such spacing distance.

10. A wall or partition according to claim 9 wherein the panels include undercut type openings at the front side edges, with those of adjacent panel edges forming undercut type grooves, with the distance across said grooves at the front thereof being less than the distance across them at the back, and wherein said grooves are filled with a complementarily shaped resilient strip material, which conceals the panel to panel joint and any clip and fastener parts which might otherwise be visible.

11. A wall or partition comprising a substructure and a surface structure, said substructure including framing or supporting means for holding the surface structure, and said surface structure comprising first and second aligned substantially flat panels, adjacent at sides thereof, each of which has concealed major back, sides, top and bottom surfaces and a visible major front surface, which panels are substantially invisibly secured to the substructure and thereby are secured together or spaced apart a spacing distance by a first series of spaced apart concealed fastener clips appended to said first panel and to be substructure, and a second series of spaced apart concealed fastener clips appended to said second panel, so located as to avoid contact with any of said first series of clips and with a part of each of the panel contacting surfaces of each of the second series of clips contacting the major back surface of the first panel and spacing such surface from the framing or supporting means, with each of the clips of both said series being made from sheet or strip material and having spacing base portions, each of which is substantially coplanar and directly continuous, extending substantially parallel to said respective panels at concealed major back surfaces of said panels, with said spacing base portions each having, spaced apart, a substructure contacting surface on one side of the material thereof and a panel contacting surface on the other side, which spacing base portions space the major back panel surface from the framing or supporting means, and which clip surfaces are spaced apart by intermediate strengthening wall(s), a plurality of web portions extending from each of said base portions and between the adjacent first and second panel sides, and pointed tabs extending from said web portions, impaling a side of the panel to which the clip is appended, and wherein a slot or equivalent opening is present in the first series clips, extending from a side of the base portion thereof to an interior location of said base portion, through the panel contacting surface thereof and in a direction substantially parallel to that of the clip webs, so as to provide a path for movement of the wall or partition in a direction at right angles to that in which it is assembled, with respect to means for holding it to the substructure, to facilitate disassembly of the wall or partition, when such may be desired.

12. A fastener clip, useful for installing wallboard or similar panels onto a substructure to form a wall or partition, wherein means for holding such panels to the substructure are substantially concealed, which is made from sheet or strip material and comprises a substantially coplanar and directly continuous spacing base portion which includes, spaced apart, a substructure contacting surface on one side of the material thereof and a panel contacting surface on the other side, spaced apart by intermediate strengthening wall(s), which spacing base portion spaces a major back panel surface from said substructure when such clip is installed, a plurality of web portions extending at about a right angle from said base portion, with reinforcing and lateral movement inhibiting indentations therein, and pointed tabs, extending from said web portions and suitable for impaling a side of a panel to which the clip is appended, with the panel contacting surface of the base contacting a major back surface of the panel and with the web contacting a side thereof.

13. A clip according to claim 12 wherein the reinforcing and lateral movement inhibiting indentations in the web portions thereof are located where such web portions are joined to the plate and to the pointed tab portions and extend from the webs to such plate and tab portions.

14. A fastener clip, useful for installing wallboard of similar panels onto a substructure to form a wall or partition, wherein means for holding such panels to the substructure are substantially concealed, which is made from sheet or strip material and comprises a substantially coplanar and directly continuous spacing base portion which includes, spaced apart, a substructure contacting surface on one side of the material thereof and a panel contacting surface of the other side, spaced apart by intermediate strengthening wall(s), which spacing base portion spaces a major back panel surface from said substructure when such clip is installed, a plurality of web portions extending at about a right angle from said base portion, pointed tabs, extending from said web portions and suitable for impaling a side of a panel to which the clip is appended, with the panel contacting surface of the base contacting a major back surface of the panel and with the webs contacting a side thereof, and a slot or equivalent opening extending from a side of the base portion to an interior location of said base portion, through the panel contacting surface thereof and in a direction substantially parallel to that of the webs, so as to provide a path for movement of a wall or partition in a direction at right angles to that in which it is assemblable, with respect to means for holding such wall to the substructure, to facilitate disassembly of the wall or partition, when such may be desired.

15. A wall or partition comprising a substructure and a surface structure, said substructure including framing or supporting means for holding the surface structure, and said surface structure comprising first and second aligned substantially flat panels, adjacent at sides thereof, each of which has concealed major back, sides, top and bottom surfaces and a visible major front surface, which panels are substantially invisibly secured to the substructure and thereby are secured together or spaced apart a spacing distance by a first series of spaced apart concealed fastener clips appended to said first panel and to the substructure, and a second series of spaced apart concealed fastener clips appended to said second panel, so located as to avoid contact with any of said first series of clips and with a part of each of the panel contacting surfaces of each of the second series of clips contacting the major back surface of the first panel and spacing such surface from the framing or supporting means, with each of the clips of both said series being made from sheet or strip material and having spacing base portions, each of which is substantially coplanar and directly continuous, extending substantially parallel to said respective panels at concealed major back surfaces of said panels, with said spacing base portions each having, spaced apart, a substructure contacting surface on one side of the material thereof and a panel contacting surface on the other side, which spacing base portions space the major back panel surface from the framing or supporting means, and which clip surfaces are spaced apart by intermediate strengthening wall(s), a plurality of web portions extending from each of said base portions and between the adjacent first and second panel sides, and pointed tabs extending from said web portions, impaling a side of the panel to which the clip is appended, and wherein clip fasteners of at least one of the series of clips include a spacing member for spacing apart the adjacent wallboard panel sides during and after installation thereof so that they are spaced apart a distance greater than the web thickness of the fasteners.

16. A fastener clip, useful for installing wallboard or similar panels onto a substructure to form a wall or partition, wherein means for holding such panels to the substructure are substantially concealed, which is made from sheet or strip hard steel and which comprises a substantially coplanar and directly continuous spacing base portion of directly connected plate and tongue parts which includes, spaced apart, a substructure contacting surface on one side of the material thereof and a panel contacting surface on the other side, with the area ratio of substructure contacting surface to panel contacting surface being in the range of 1:7 to 7:1, spaced apart by intermediate strengthening wall(s) which is/are in total, at least as long as 25% of the periphery of the base portion, which wall(s) is/are at about a right angle to the substructure contacting and panel contacting surfaces of the base portion of the clip, which surfaces are substantially parallel to each other, with the depth of the intermediate strengthening wall(s) being about 1 to 3 times the thickness of the clip material, which spacing base portion spaces a major back panel surface from said substructure when such clip is installed, a plurality of web portions extending only from the plate part at about a right angle from said base portion, and pointed tabs, extending from said web portions in the direction of the plate part and suitable for impaling a side of a panel to which the clip is appended, with the panel contacting surface of the base contacting a major back surface of the panel and with the webs contacting a side thereof.

17. A fastener clip, useful for installing wallboard or similar panels onto a substructure to form a wall or partition, wherein means for holding such panels to the substructure are substantially concealed, which is made from sheet or strip material and which comprises a substantially coplanar and directly continuous spacing base portion which includes, spaced apart, a substructure contacting surface on one side of the material thereof and a panel contacting surface on the other side, spaced apart by intermediate strengthening wall(s), which spacing base portion spaces a major back panel surface from said substructure when such clip is installed, a plurality of web portions extending at about a right angle from said base portion, pointed tabs, extending from said web portions and suitable for impaling a side of a panel to which the clip is appended, with the panel contacting surface of the base contacting a major back surface of the panel and with the webs contacting a side thereof, and a spacing member for spacing apart wallboard panels during and after installation thereof with the aid of said clip so that they are spaced apart a distance greater than the web thickness.

18. A fastener clip, useful for installing wallboard or similar panels onto a substructure to form a wall or partition, wherein means for holding such panels to the substructure are substantially concealed, which is made from sheet or strip material and which comprises a substantially coplanar and directly continuous spacing base portion of substantially coplanar and directly connected plate and tongue parts, which includes, spaced apart, a substructure contacting surface on one side of the material thereof and a panel contacting surface on the other side, spaced apart by intermediate strengthening wall(s), which spacing base portion spaces a major back panel surface from said substructure when such clip is installed, a plurality of web portions, farther apart than the width of the tongue, which is centered between them, so that clearances are provided between the webs and the tongue, which facilitate manufacture of the clip and installation thereof, which web portions extend only from the plate part, at about a right angle from said base portion, and pointed tabs, extending from said web portions in the direction of the plate part and suitable for impaling a side of a panel to which the clip is appended, with the panel contacting surface of the base contacting a major back surface of the panel and with the web contacting a side thereof.

19. A fastener clip, useful for installing wallboard or similar panels onto a substructure to form a wall or partition, wherein means for holding such panels to the substructure are substantially concealed, which is made from sheet or strip material and which comprises a substantially coplanar and directly continuous spacing base portion which includes, spaced apart, a substructure contacting surface on one side of the material thereof and a panel contacting surface on the other side, spaced apart by intermediate strengthening wall(s), which spacing base portion comprises substantially coplanar and directly connected plate and tongue parts and spaces a major back panel surface from said substructure when such clip is installed, a plurality of web portions extending only from the plate part and at about a right angle from said base portion, and pointed tabs, extending from said web portions and suitable for impaling a side of a panel to which the clip is appended, with the panel contacting surface of the base contacting a major back surface of the panel and with the webs contacting a side thereof.

20. A clip according to claim 19 in which there are two webs only and the pointed tabs extend in the direction of the plate part.

21. A clip according to claim 20 in which the tongue is centrally located with respect to the base and the tongue includes a longitudinal slot for adjustable fastening of the clip to a framing member.

22. A wall or partition comprising a substructure and a surface structure, said substructure including framing or supporting means for holding the surface structure to and spaced away from the substructure, and said surface structure comprising first and second aligned substantially flat panels, adjacent at sides thereof, each of which has concealed major back, sides, top and bottom surfaces and a visible major front surface, the sides of which panels are substantially straight and flat, which panels are substantially invisibly secured to the substructure and spaced away from it, and thereby are secured together or spaced apart a spacing distance, by a first series of spaced apart concealed fastener clips appended to said first panel and to the substructure, and a second series of spaced apart concealed fastener clips appended to said second panel, so located as to avoid contact with any of said first series of clips and with a part of each of the panel contacting surfaces of each of the second series of clips contacting the major back surface of the first panel and spacing such surface from the framing or supporting means, with each of the clips of both said series being made from sheet or strip material and having spacing base portions, each of which is substantially coplanar and directly continuous, extending substantially parallel to said respective panels at concealed major back surfaces of said panels, with said spacing base portions each having, spaced apart, a substructure contacting surface on one side of the material thereof and a panel contacting surface on the other side, which spacing base portions space the major back panel surface from the framing or supporting means a distance greater than the thickness of the material of the clips, and which clip surfaces are spaced apart by intermediate strengthening wall(s), a plurality of web portions extending from each of said base portions and between the adjacent first and second panels sides, and pointed tabs extending from said web portions, impaling a side of the panel to which the clip is appended.

23. A wall or partition according to claim 22 wherein a panel or substructure contacting surface of a clip fastener of the second series of clips is peripherally or substantially peripherally located on the clip base and the other such contacting surface of such clip is interiorly located on such base.

24. A wall or partition according to claim 22 wherein a surface of the base portion of a clip fastener of the second series of clips is roughened, knurled, indented, grooved or equivalently structured so as to provide a plurality of possible starting locations for penetrating said part of the base for passage therethrough of a fastener.

25. A wall or partition according to claim 22 wherein a clip fastener of the second series of clips includes a base portion having an interiorly located panel contacting surface and an exteriorly located, with respect to such panel contacting surface, framing contacting surface.

26. A wall or partition according to claim 22 wherein a panel or substructure contacting surface of the clip fastener of the second series of clips is in the form of a strip paralleling or substantially paralleling the periphery of the clip, interiorly located with respect to said periphery and supported by rigidifying and spacing wall(s).

27. A wall or partition according to claim 22 wherein the panels include complementary longitudinal openings at the front side edges thereof and such openings of the assembled wall are filled with a strip material.

28. A wall or partition according to claim 22 wherein the panel contacting surfaces of the clips of the first series contact the major back surface of the second panel.

29. A wall or partition according to claim 28 wherein the structure contacting surface and panel contacting surface of the clip fasteners are of area proportions in the range of 1:14 to 14:1 and are spaced apart by intermediate strengthening wall(s) at least as long, in total, as 10% of the periphery of the base portion and at least $\frac{3}{4}$ as deep as the thickness of the sheet or strip material of which the fastener clip is made.

30. A wall or partition according to claim 29 wherein the ratio of surface area proportions of the clip substructure contacting surface and panel contacting surface is from 1:7 to 7:1, the intermediate strengthening wall(s), in total, is/are at least as long as 25% of the periphery of the base portion and the depth of such wall(s) is $\frac{3}{4}$ to 5 times the thickness of the sheet material of which the fastener clip is made.

31. A fastener clip, useful for installing wallboard or similar panels onto a substructure to form a wall or partition, wherein means for holding such panels to the substructure are substantially concealed, which is made from sheet or strip material and which comprises a substantially coplanar and directly continuously spacing base portion which includes, spaced apart, a substructure contacting surface on one side of the material thereof and a panel contacting surface on the other side, spaced apart by intermediate strengthening wall(s), which spacing base portion spaces a major back panel surface of the panel from said substructure a distance greater than the thickness of the sheet or strip material of the clip, when such clip is installed, a plurality of web portions extending at about a right angle from said base portion, and pointed tabs, extending from said web portions and suitable for impaling a substantially flat side of a panel to which the clip is appended, with the panel contacting surface of the base contacting a major back surface of the panel and with the webs contacting a substantially flat side thereof.

32. A clip according to claim 31 wherein the substructure contacting surface and panel contacting surface of the base portion are of an area ratio in the range of 1:14 to 14:1 and are spaced apart by intermediate strengthening wall(s) at least as long, in total, as 10% of the periphery of the base portion and at least $\frac{3}{4}$ as deep as the thickness of the sheet or strip material of the clip.

33. A clip according to claim 32 wherein the ratio of the surface areas of the substructure contacting and panel contacting surfaces is in the range of 1:7 to 7:1, the intermediate strengthening wall(s), in total, is/are at least as long as 25% of the periphery of the base portion and the depth of such wall(s) is $\frac{3}{4}$ to 5 times the thickness of the sheet material of the clip.

34. A clip according to claim 31 wherein a panel or substructure contacting surface thereof is peripherally or substantially peripherally located on the base portion and the other such contacting surface is interiorly located on such base portion.

35. A clip according to claim 31 wherein a surface of the base portion is roughened, knurled, indented, grooved or equivalently structured so as to provide a plurality of possible starting locations for penetrating such parts of the base portion for passage therethrough of a fastener.

36. A clip according to claim 31 wherein the base portion includes an interiorly located panel contacting surface and an exteriorly located, with respect to such panel contacting surface, framing contacting surface.

37. A clip according to claim 31 wherein a panel or substructure contacting surface is in the form of a strip paralleling or substantially paralleling the periphery of the clip, interiorly located with respect to said periphery and supported by rigidifying and spacing wall(s).

38. A clip according to claim 31 which is made of heat treated and thereby hardened steel, which is heat treated after shaping to form from strip or steel which is heat hardenable.

39. A clip according to claim 38 which is of spring steel.

* * * * *